US006639990B1

(12) United States Patent
Astrin et al.

(10) Patent No.: US 6,639,990 B1
(45) Date of Patent: Oct. 28, 2003

(54) LOW POWER FULL DUPLEX WIRELESS LINK

(76) Inventors: Arthur W. Astrin, 1051 Greenwood Ave., Palo Alto, CA (US) 94301; Steven H. Puthuff, 13001 Saratoga-Sunnyvale Rd., Saratoga, CA (US) 95070

( * ) Notice: Subject to any disclaimer, the term of this patent is extended or adjusted under 35 U.S.C. 154(b) by 0 days.

(21) Appl. No.: 09/204,862

(22) Filed: Dec. 3, 1998

(51) Int. Cl.[7] ..... H04R 25/00
(52) U.S. Cl. ..... 381/315; 381/312; 455/11.1
(58) Field of Search ..... 381/312, 315; 455/11.1, 41, 106; 342/42–51; 340/825.54, 406, 403

(56) References Cited

U.S. PATENT DOCUMENTS 4,180,814 A 12/1979 Barton
4,746,830 A 5/1988 Holland
4,746,882 A 5/1988 Solie
4,773,063 A 9/1988 Hunsperger et al.
5,054,873 A 10/1991 Davis et al.
5,341,140 A * 8/1994 Perry ..... 342/44
5,483,369 A 1/1996 Darcie et al.
5,488,866 A 2/1996 Ravel et al.
5,512,899 A * 4/1996 Osawa et al. ..... 342/25
5,648,982 A 7/1997 Durrant et al.
5,680,414 A 10/1997 Durrant et al.
5,721,783 A 2/1998 Anderson
5,724,383 A 3/1998 Gold et al.

OTHER PUBLICATIONS

RF Monolithics, Inc. 1995 Data Book, pp. 5–40 and 5–41.
Loukine, M.Y. and Cole, P.H., "Integral backscattering transponders for low cost RFID applications," Proc. 4th Annual Wireless Symp., Santa Clara CA, USA [Feb. 1996]; pp. 328–336.

* cited by examiner

*Primary Examiner*—Sinh Tran
(74) *Attorney, Agent, or Firm*—Bingham McCutchen, LLP; David G. Beck

(57) ABSTRACT

A two-way communication system using a delay element in one unit allows frequency information from an uplink signal received during an uplink receiving period to be delayed, then modulated and amplified for use in a transmitted signal in a downlink transmitting period.

33 Claims, 7 Drawing Sheets

LOW POWER FULL DUPLEX WIRELESS LINK

BACKGROUND OF THE INVENTION

1. Field of the Invention

The present invention relates to radio frequency wireless systems that interconnect between an earpiece unit and a remote processing unit.

2. State of the Art

Recently, the usefulness of a device having a small earpiece unit capable of uplink and downlink wireless communication to a remote processing unit (RPU) has been realized. Such systems can be used as hearing aids or other communication devices. Audio data is transferred in a downlink connection between the earpiece unit and the remote processing unit and in an uplink connection between the remote processing unit and the earpiece unit. Such units can be part of a short-range body-worn network (Body LAN).

Typically, a radio frequency signal is used for the uplink and downlink connections. Since the downlink signal from the earpiece is in the radio frequency range, typically, the earpiece contains a radio frequency oscillator. Useful radio frequency oscillators are bulky and require a relatively large amount of power which can result in a battery too large for the earpiece unit. Furthermore, when a radio frequency oscillator is used in the earpiece unit, there can be discrepancies between the frequencies of the radio frequency oscillator in the remote processing unit and the earpiece unit. Such discrepancies can be the result of frequency drift or manufacturing differences in the radio frequency oscillators.

One way to remove the need for the radio frequency oscillator in the earpiece unit is to use the radio frequency energy of a unmodulated portion of an uplink signal to power a modulated downlink signal. An example of such a reflected power system is described in Anderson, U.S. Pat. No. 5,721,783. A radio frequency oscillator in the earpiece unit is not required because frequency of the unmodulated portion of the uplink signal is used for the downlink signal. The problem with such a reflected energy system is that there is typically not enough power in the downlink signal. For example, one prototype system produced to test such a reflective system had about a 50 dB shortfall in power for a reliable downlink connection. Thus, the reflected energy system either requires that the uplink power be very high or that the remote processing unit be able to detect a very weak downlink signal.

It is desired to have an improved system that does not use a radio frequency oscillator in the earpiece unit in order to reduce the required power and size of the earpiece.

SUMMARY OF THE PRESENT INVENTION

The present invention generally relates to the use of a delay element such that frequency information from the uplink signal received in an uplink signal receiving period can be used for the transmitted signal sent in a later downlink transmitting period.

The use of a delay allows for the transmitted signal to be amplified. Simply amplifying the received signal without using a delay will result in undesirable feedback oscillations. Additionally, the use of the delay means that an unmodulated portion of uplink signal need not be sent to the earpiece unit during the downlink transmitting period. This will reduce the interference between the uplink and downlink signals.

A delay device that maintains the frequency information of RF signals is needed for use as the delay element of the present invention. An example of a delay element for radio frequency signals that can be used with the present invention is a surface acoustic wave (SAW) device. Surface acoustic wave devices convert input electrical signals into surface acoustic wave signals which take a given amount of time to transfer through the surface acoustic wave device. The output of the surface acoustic wave device is an electrical signal re-converted from the surface acoustic wave.

The surface acoustic wave devices can be designed to act as a relatively narrow bandpass filter at the desired frequency. In this way, undesirable signals at nearby frequencies received by the antenna are filtered away before the frequency information is used in a downlink signal.

A variety of modulation schemes can be used. In one embodiment of the present invention, the modulation of the downlink information is done using pulse position modulation (PPM). Two different delays are preferably used. One delay indicates a logical "zero" and the other delay indicates a logical "one". This can be implemented using a commercially available two output surface acoustic wave device.

The advantage of the systems of the present invention is that no radio frequency oscillator need be used in the earpiece unit. This reduces the supply power and size of the earpiece unit. Additionally, the frequencies of the uplink and the downlink signals will be exactly matched even if there is any drift or manufacturing variation in the radio frequency oscillator for the uplink signal, since the frequency information from the uplink signal is used for the downlink signal. Further, an amplified rather than reflected signal can be used for the downlink signal, thus the downlink signal can be kept relatively strong without requiring an overly powerful uplink signal. In a preferred embodiment, the power of the uplink and downlink signals are comparable.

DETAILED DESCRIPTION OF THE PREFERRED EMBODIMENTS

Figure 1A:
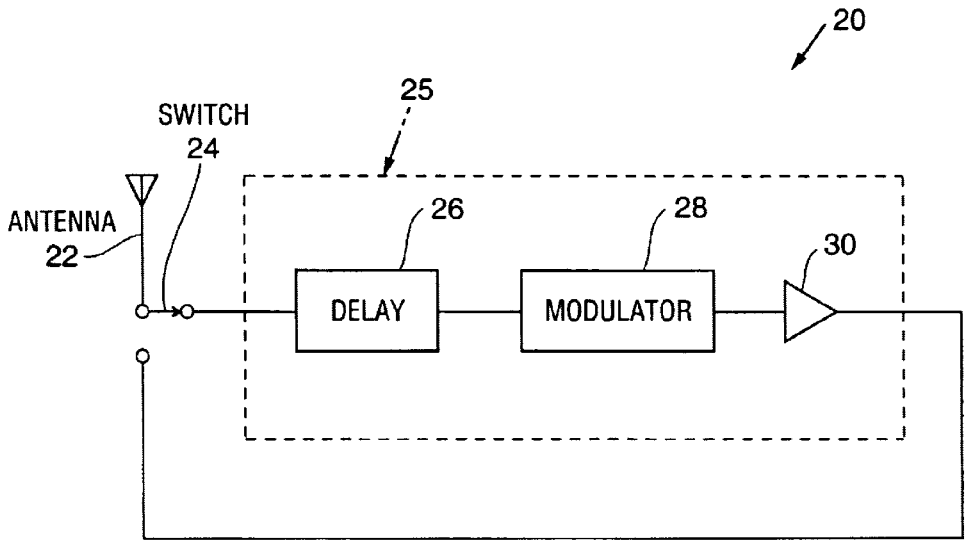
FIG. 1A is a simplified diagram of the earpiece unit of one embodiment of the present invention with the antenna switched to the input of processing circuitry including a delay element.
Figure 1B:
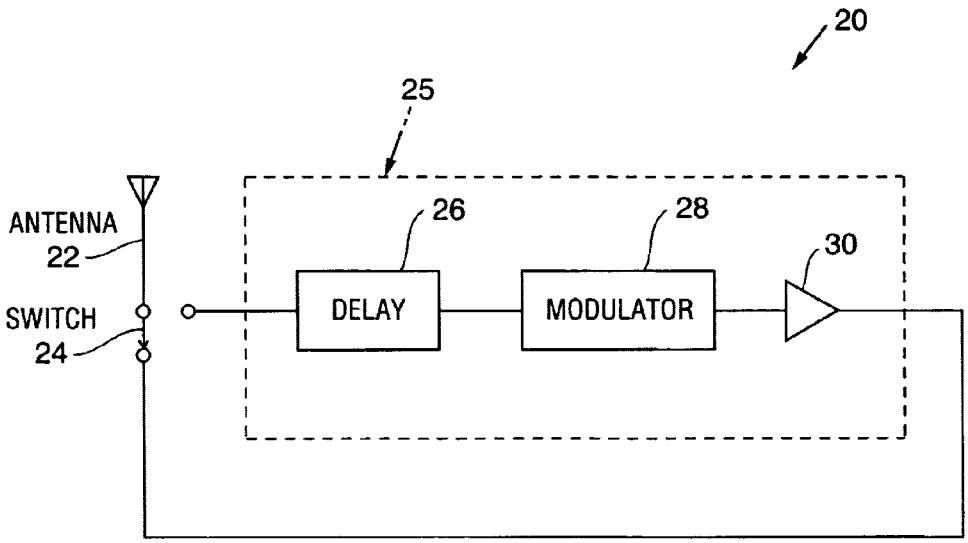
FIG. 1B is a diagram of the earpiece unit of FIG. 1A with the antenna switched to the output of the processing circuitry including the delay element.
Figure 2A:
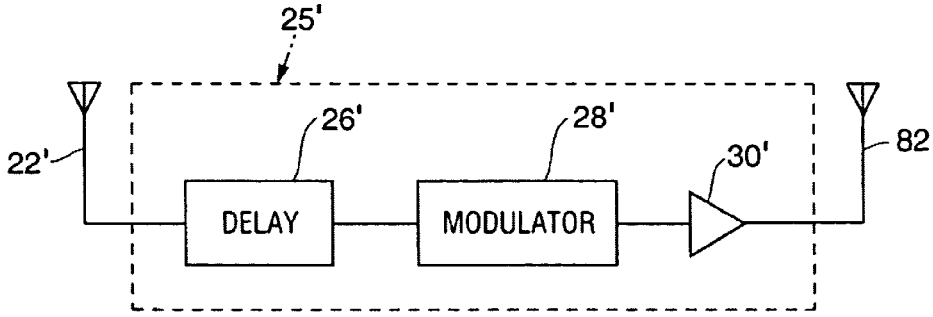
FIGS. 2A–2C are diagrams illustrating alternate embodiments of the present invention.
Figure 2B:
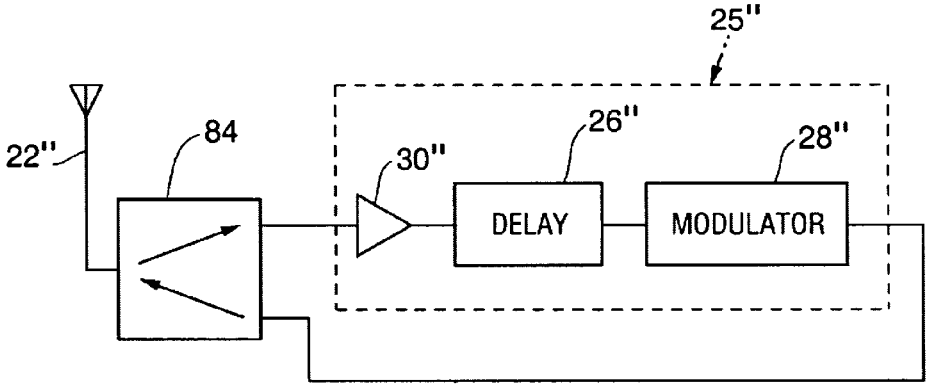
Figure 2C:
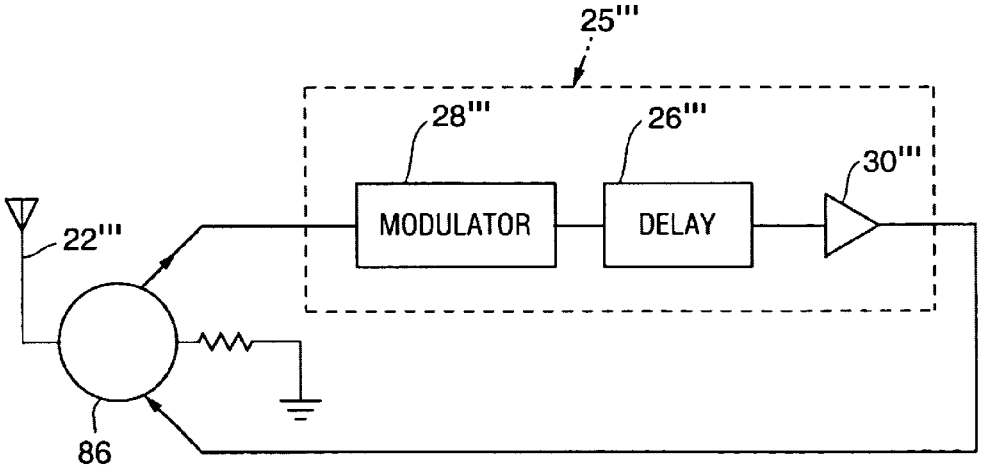

FIGS. 1A and 1B are simplified diagrams of one embodiment of an earpiece unit of the present invention. The earpiece units have an antenna 22 which is preferably designed to receive and transmit RF signals. In one preferred embodiment, the frequency range in the region of 5850–5875 MHz is used for the uplink and downlink signals. The antenna 22 is connected to the processing circuitry 25 through the switch 24. Alternately, as shown in FIGS. 2A–2C below, a directional coupler, circulator, or two antennas could be used instead.

Processing circuitry 25 is used to delay frequency information of the received signal from a receive period to a transmit period using delay element 26, and to downlink modulate the signal with modulator 28. An amplifier 30 may be used to increase the power of the transmitted signal. Optionally, the processing circuitry can omit an amplifier. The use of the delay element 26 allows the transmitted signal to be sent during a period when there is no interference from an uplink signal. This can be an advantage even if no amplifier is used.

FIG. 1A shows the switch 24 switched to the input port of the processing circuitry 35. This allows a received signal to be sent to the processing circuitry 25. FIG. 1B shows the switch 24 switched to the output port of the processing circuitry 25. This allows the delayed, modulated, and amplified signal to be transmitted from the antenna 22. The switch 24 is connected to the input port during a receive period, as shown in FIG. 1A, and connected to the output port of the system 20 during a transmit period, as shown in FIG. 1B.

The delay element 26 is selected so that the received signals can be delayed until the transmitting period. In a preferred embodiment, the delay element is a surface acoustic wave device designed to operate on radio frequency signals.

The modulator 28 can use a variety of modulation schemes. An embodiment using pulse position modulation is described below with respect to FIG. 2, however any of a variety of common modulation methods such as Frequency Modulation (FM), Amplitude Modulation (AM), Phase Modulation (PM), Pulse Width Modulation (PWM), Phase-Shift Keying (PSK), Binary Phase-Shift Keying (BPSK), and Quadrature Phase-Shift Keying (QPSK) could also be used.

The amplifier 30 preferably amplifies the signal such that the transmitted downlink signal is comparable in power to the uplink signal. Therefore, if there would otherwise be 50 dB attenuation between the signals if the amplifier 30 was not present, the amplifier 30 is selected to have a 50 dB gain. Looking at FIGS. 1A and 1B, note that the amplifier 30 is never connected such that the output of the amplifier is fed back into its input. This prevents feedback oscillations from occurring.

As shown in FIG. 1A and 1B, the use of the delay element 26 allows for the frequency information of the input signal to be delayed and then used in the transmitted output signal. Note that the delay element 26, modulator 28 and amplifier 30 can be positioned in different locations within the processing circuitry 25. For example, the modulator 28 could be positioned before the delay element 26.

FIGS. 2A–2C show alternate embodiments of the system of the present invention. These systems do not use the switch shown in FIGS. 1A–1B. FIG. 2A shows the use of a receive antenna 22' and a transmit antenna 82. The delay 26' insures that the signal received by antenna 22' in a first time period will be transmitted from antenna 82 in a second time period. Care must be taken to avoid cross-coupling of the transmit and receive antennas.

FIG. 2B shows the use of a directional coupler 84 to allow signals from antenna 22" to be sent to the input port of processing circuitry 25" and an output signal from the output port of processing circuitry 25" to be sent to the antenna 22" without interfering with one another.

FIG. 2C shows the use of a circulator 86. The circulator 86 ensures that the signal received from antenna 22" goes to the input port of processing circuitry 25" and the output signal from the processing circuitry 25" goes to antenna 22".

Figure 3:
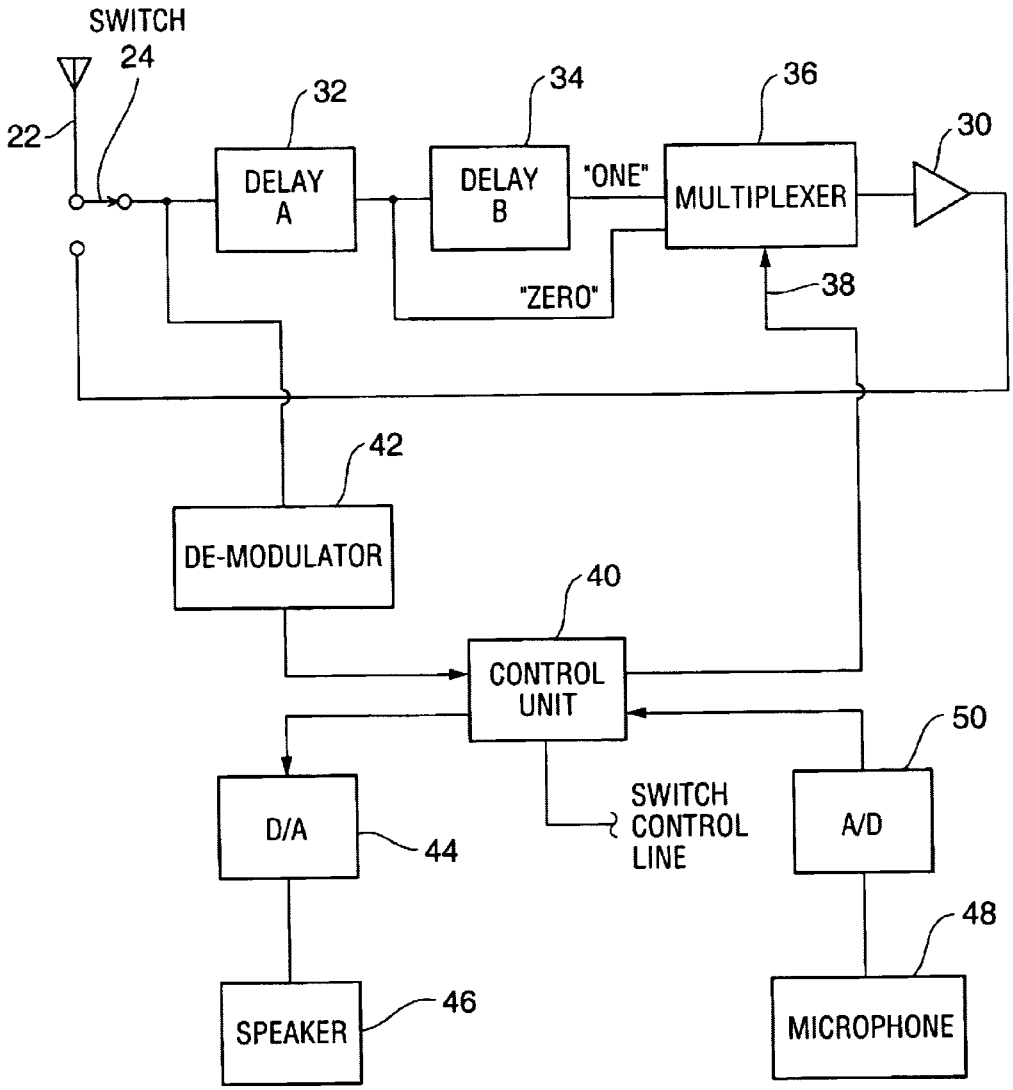
FIG. 3 is a more detailed diagram of one embodiment of the earpiece unit of the present invention.

FIG. 3 is a diagram that shows one embodiment of the earpiece unit of the present invention using pulse position modulation to modulate the downlink signal. The input to the system is sent to delay element 32 having a delay A. The delay period A ensures that the frequency information of the signal received during the input receiving period is delayed sufficiently to be used during the output period.

The multiplexer 36 has one input connected to the output of delay element 32 and the other input connected to the output of delay element 34, whose input is also connected to the output of delay element 32. The signals on control line 38 connected to multiplexer 36 determine whether the signal is delayed by the period of delay A or the period of delay A plus delay B. The pulse position modulated signal is transmitted as the downlink signal. The control signals for the multiplexer 36 representing the data to be sent are provided by the control unit 40.

In one embodiment, a demodulator 42 is connected to receive the uplink received signals. The demodulator 42 demodulates the signals into digital signals which are sent to the control unit 40. In one embodiment, the control unit 40 separates the uplink data into overhead information, such as address data, and audio data information. If the address data from the remote processing unit matches the identification number for the earpiece unit, the audio data is sent to a digital-to-analog converter 44 and then sent to the speaker system 46. The speaker system 46 can comprise one or more speaker drivers. The audio data can be a communication signal from an communication link connected to the remote processing unit or can be a processed audio signal. A microphone 48 may be positioned in the earpiece unit to pick up audio data which is converted in the analog-to-digital converter 50. This produces a digital data stream which is sent to the control unit 40. The control unit 40 takes the digital audio data, adds overhead information, such as address data, error correction bits, etc., and sends the combined signal on line 38 to be modulated as downlink data. The control unit 40 can also be used to control the switch 24 to define the receiving and transmitting periods of the multiplexing antenna.

Figure 4:
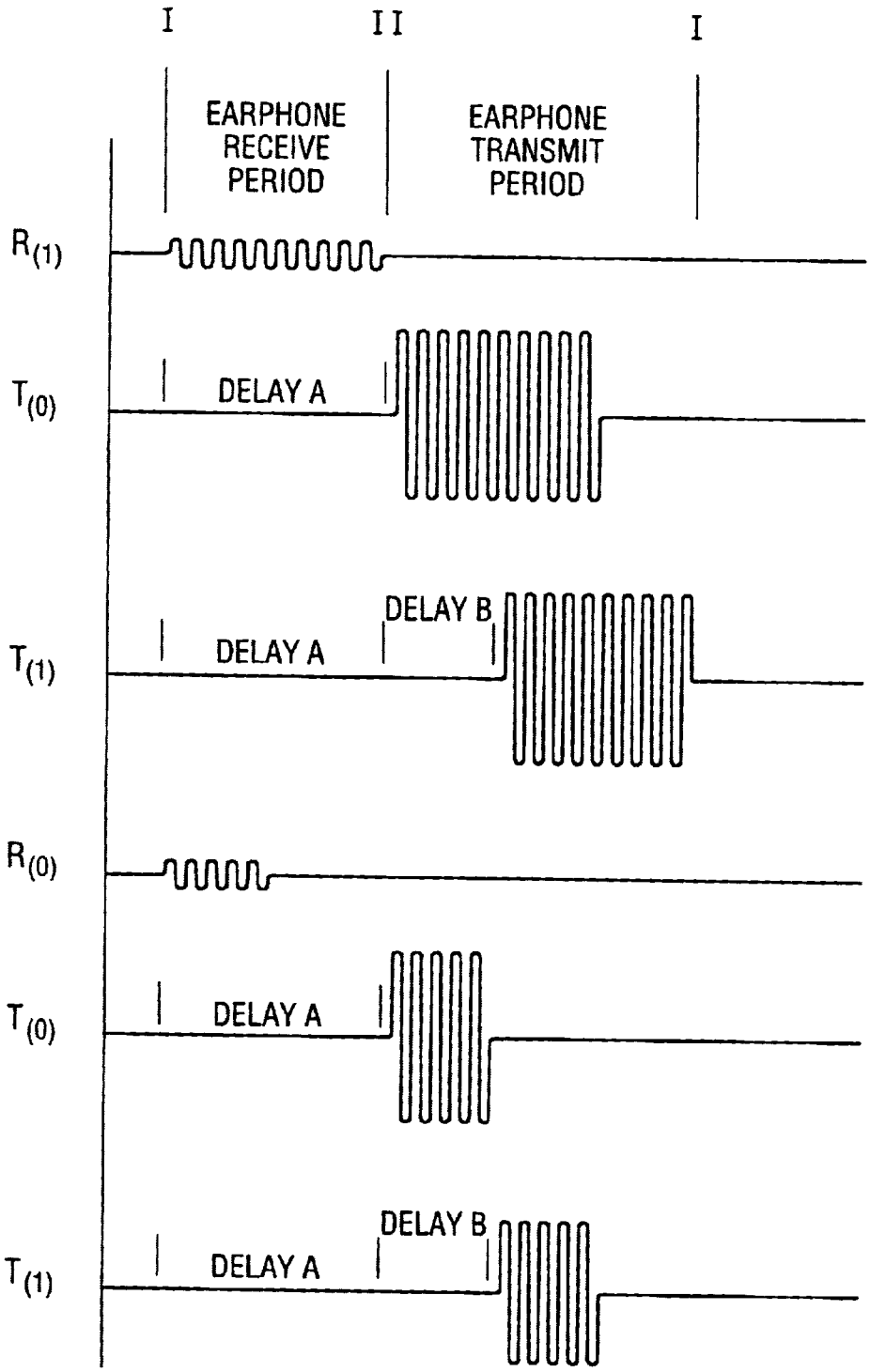
FIG. 4 is timing diagram illustrating the encoding of the downlink and uplink signals for pulse position modulated downlink signals.

FIG. 4 is a timing diagram that illustrates one embodiment of the modulation scheme of the present invention. As shown in FIG. 3, the uplink signals can be modulated using pulse width modulation (PWM). For example, the receive pulse for the value "one", R(1) is wider than the receive pulse for the value "zero", R(0). The earphone receive period is initiated by the switch 24 in FIGS. 1 and 2, switching to the input port position at time I. A relatively weak receive pulse is received by the earpiece. The received pulse is then delayed by the delay A. This delay ensures that the frequency information of the received signals are available to transmit during the earphone transmit period which occurs when the switch 24 switches to the output position at time II. As is discussed above, the use of a switch is not critical to the present invention, two antennas, a circulator, or a directional coupler could be used instead.

The transmitted pulses can be modulated using pulse position modulation. The delay of delay A plus delay B indicates transmitted signal T(1). The delay of delay A indicates transmitted signal T(0). Note that the transmitted signals use the frequency information of the input signal so that no radio frequency oscillator needs to be used in the earpiece. The transmitted signal is amplified considerably compared to the received signal. In one embodiment, there is around 50 dB amplification. The length of the transmitted signal depends upon the length of the received signal, but this does not affect the pulse position demodulation at the remote processing unit. The remote processing unit will be able to demodulate the transmitted downlink signal because the remote processing unit knows the start of the uplink signal and can thus calculate the delay time between the uplink and the downlink signals.

Figure 5A:
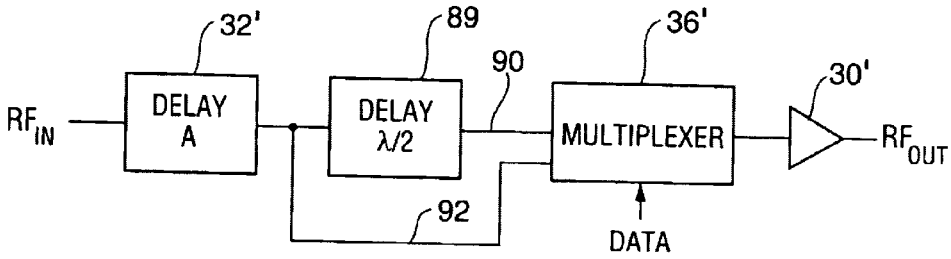
FIGS. 5A–5D are diagrams illustrating the use of phase-shift keying downlink modulation.

FIGS. 5A–5D show alternate embodiments of the present invention using phase-shift keying (PSK). In these embodiments, the phase of the downlink signal provides information about the modulation. FIG. 5A shows an embodiment using a half-wavelength delay 89 to produce binary phase-shift keying (BPSK).

Figure 5B:
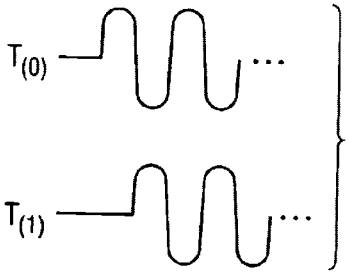

As shown in FIG. 5B, the signal on line 90 (indicating a transmitted logical "one" value) is delayed a half-wavelength from the signal on line 92 (indicating a transmitted logical "zero" value). The remote processing unit can demodulate these signals because the radio frequency oscillator at the RPU will have a fixed phase with respect to each of the transmitted downlink signals.

Figure 5C:
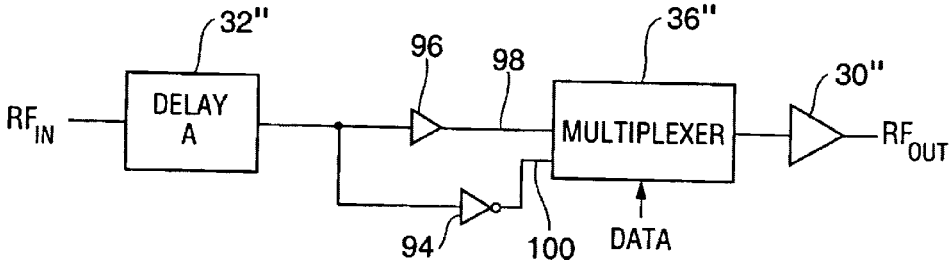

FIG. 5C shows an alternate embodiment of a binary phase-shift keying modulation scheme. In this alternate embodiment, the output of the delay 32" is sent to an inverting amplifier 94 and a non-inverting amplifier 96. Thus, the signals on lines 98 and 100 will have opposite phases. The non-inverting amplifier 96 is used to match the delay of the inverting amplifier.

Figure 5D:
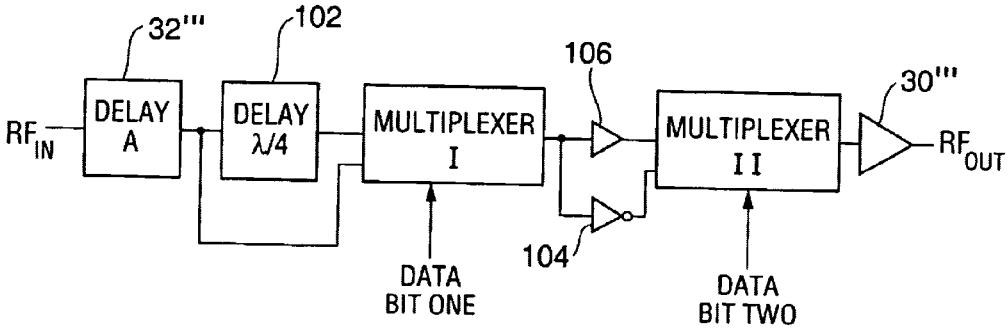

FIG. 5D shows an embodiment using quadrature phase-shift keying (QPSK). In this embodiment, a quarter-wavelength delay 102 is used along with inverting amplifier 104 and non-inverting amplifier 106. Multiplexer 108 and Multiplexer 106 are used to select one of four possible phases for the transmitted signal. In this way, two bits of data can be transmitted in each downlink modulated pulse.

Figure 6:
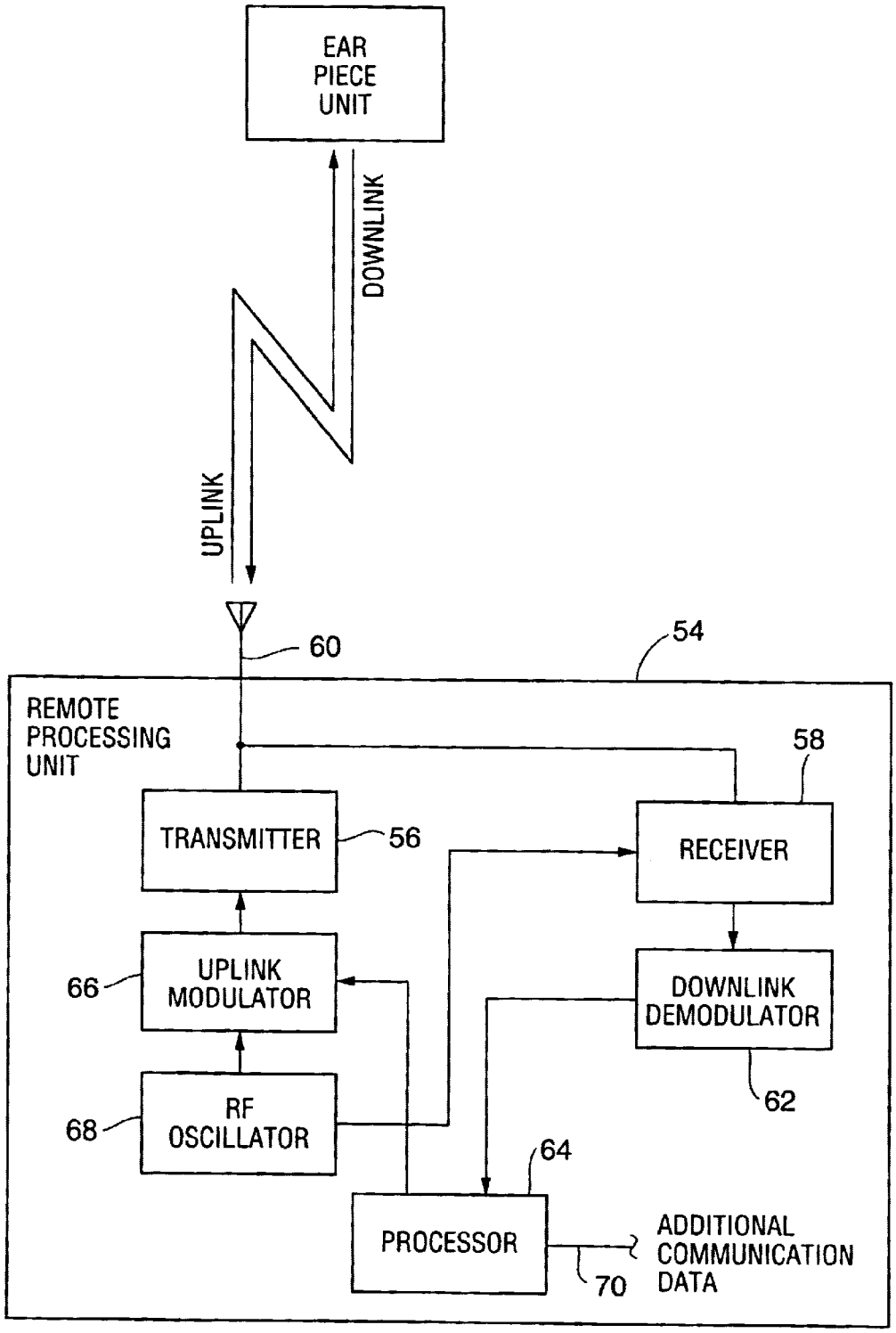
FIG. 6 is a diagram illustrating one embodiment of a remote processing unit for use with the present invention.

FIG. 6 illustrates an embodiment showing the remote processing unit as well as the earpiece unit. The earpiece unit can be used as a hearing aid, as part of a communication device or as part of another information device. The remote processing unit 54 receives downlink signals and transmits uplink signals. The remote processing unit 54 includes a transmitter 56, receiver 58, and antenna 60. The received signals are demodulated in the downlink demodulator 62 and sent to the processor 64. Processor 64 also sends signals to uplink modulator 66 which is connected to the transmitter 56 to transmit signals out the antenna 60. Typically, a radio frequency oscillator 68 is used to produce the transmitted signals. The remote processing unit can be larger with a larger battery than the battery in the earpiece unit.

The remote processing unit can receive downlink signals which could include unprocessed audio received from the microphone in the earpiece. This audio could be processed in processor 64, for example to correct a hearing impairment, and then re-transmitted to be reproduced by the speaker in the earpiece. Furthermore, additional communication data from line 70 can be sent to the earpiece unit. The earpiece unit can be used as communication device to allow the user to receive communication data even in a chaotic environment. This is quite valuable for people like policemen or firemen who need to be mobile in relatively loud environments while receiving audio communications.

Figure 7A:
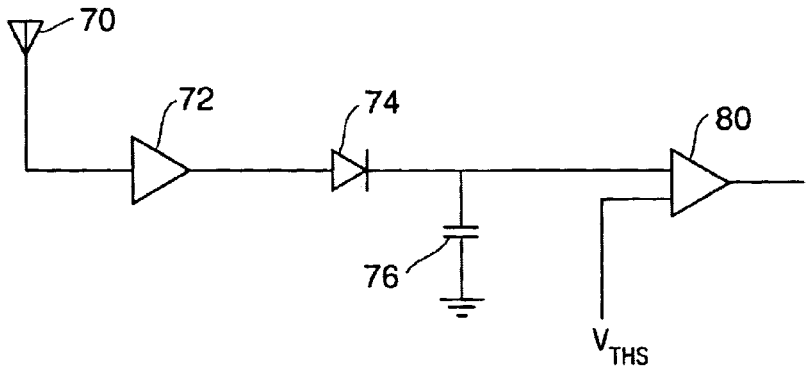
FIG. 7A is a diagram of one embodiment of a demodulator for use in the earpiece unit.
Figure 7B:
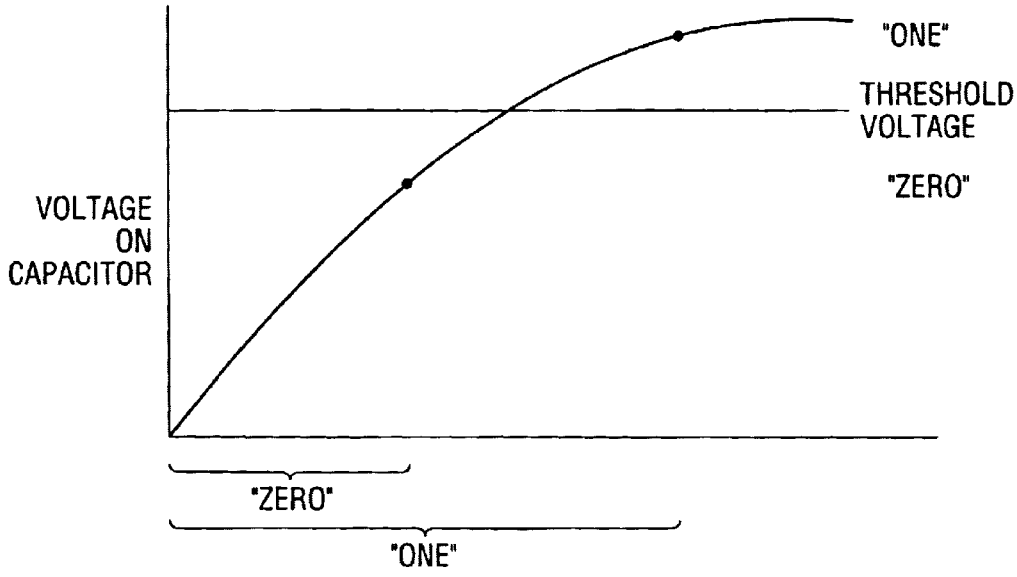
FIG. 7B is a graph illustrating the operation of the demodulator of FIG. 7A.

FIG. 7A shows one embodiment of the demodulator that can be used in the earpiece unit, for example as demodulator 42. The antenna 70 receives a transmitted uplink signal, this signal is passed through an amplifier or buffer 72 and rectifier 74. The rectifier 74 is connected to a capacitor 76. As the received signal is coming in, the voltage on the capacitor increases as shown in FIG. 7B. This voltage is compared to a threshold voltage at the comparator 80. If the capacitor is charged for a short pulse period the capacitor voltage will be below the threshold voltage and a "zero" will be output by the comparator 80. If the capacitor is charged for a long pulse period, the voltage on the capacitor will be greater than the threshold voltage and a logical "one", value will be output by the comparator 80. A switch (not shown) can be used to discharge the capacitor between pulses. FIG. 7A illustrates only one possible embodiment of the uplink signal demodulator.

Various modifications in form and detail of the described embodiments of the disclosed invention, as well as other variations of the present invention, will be apparent to one skilled in art upon reference to the present disclosure. In particular, the modulation scheme for the uplink and downlink signals are not to be limited to pulse width modulation and pulse position modulation. Many other modulation methods can be used with the present invention.

People skilled in the art will understand that a variety of modulation schemes can be used in which the downlink signal makes use of the frequency information of the uplink signal all of which should be considered to be a part of the present invention.

Additionally, the present invention can be used in a variety of other systems other than the system using an earpiece unit and remote processing unit described above. Any system that has two-way communication in which it is desired to remove an oscillator from one unit can preferably use the method and apparatus of the present invention. Further, multiple antennas could be used at the remote processing unit or at the earpiece.

It is therefore contemplated that the claims should cover any such modifications for variations of the described embodiments as falling within the true spirit and scope of the present invention.

What is claimed is:

1. An apparatus, comprising:

an antenna for receiving an uplink signal during a receive period and for transmitting a downlink signal during a transmit period; and processing circuitry operably connected to the antenna, said processing circuitry processing the uplink signal to generate the downlink signal, the processing circuitry having an input port and an output port and further comprising:

a delay element, said delay element causing a predetermined delay of the transmit period from the receive period so that the downlink signal is transmitted during the transmit period without interference from the uplink signal, and a modulator for modulating the uplink signal to generate the downlink signal, wherein an uplink signal carrier frequency is equivalent to a downlink signal carrier frequency, no unmodulated portion of the uplink signal is required for transmission of the downlink signal, and no radio frequency generating means is included in the apparatus.

2. The apparatus of claim 1, wherein the processing circuitry further includes an amplifier for amplifying the uplink signal.

3. The apparatus of claim 1, further comprising a switch operably connected between the antenna and the processing circuitry, wherein the switch is adapted to switch between the output port and the input port.

4. The apparatus of claim 3, wherein the switch is operated such that the apparatus time-multiplexes between the receive period in which the switch is connected to the input port and the transmit period in which the switch is connected to the output port.

5. The apparatus of claim 1, further comprising a circulator operably positioned between the processing circuitry and the antenna.

6. The apparatus of claim 1, wherein the modulator is positioned before the delay element.

7. The apparatus of claim 1, wherein the delay element is positioned before the modulator.

8. The apparatus of claim 1, wherein the modulator in conjunction with the delay element uses pulse position modulation to modulate the uplink signal for generating the downlink signal.

9. The apparatus of claim 1, wherein the downlink signal carrier frequency is in the radio frequency range.

10. The apparatus of claim 1, further comprising a demodulator operably connected to the input port to demodulate the received uplink signal.

11. The apparatus of claim 10, further comprising a speaker system wherein data from the demodulated signal is used to drive the speaker system.

12. The apparatus of claim 10, wherein part of the demodulated signal contains address information.

13. The apparatus of claim 1, further comprising a microphone adapted to convert sound signals to electronic signals, the electronic signals used to control the modulator.

14. The apparatus of claim 1, wherein the apparatus comprises a portion of a hearing aid.

15. A system including the apparatus of claim 1, further comprising a remote processing unit, wherein the remote processing unit is used to send the uplink signal to the apparatus and to receive the downlink signal from the apparatus.

16. The apparatus of claim 1, wherein the delay element comprises a surface acoustic wave device.

17. The apparatus of claim 1, wherein the delay element and modulator comprise means to pulse position modulate the received uplink signal with two different delays.

18. The apparatus of claim 17, wherein the means comprises a surface acoustic wave device connected to a multiplexer.

19. An apparatus comprising:

an antenna for receiving an uplink signal during a receive period and for transmitting a downlink signal during a transmit period; and processing circuitry operably connected to the antenna, said processing circuitry processing the uplink signal to generate the downlink signal, the processing circuitry having an input port and an output port and further comprising:

a delay element, said delay element causing a predetermined delay of the transmit period from the receive period so that the downlink signal is transmitted during the transmit period without interference from the uplink signal, a modulator, said modulator in conjunction with the delay element using pulse position modulation to modulate the uplink signal to generate the downlink signal, an amplifier, and a switch operably connected between the antenna and the processing circuitry, wherein the switch is adapted to switch between the output port and the input port such that the apparatus time-multiplexes between the receive period in which the switch is connected to the input port and the transmit period in which the switch is connected to the output port, wherein an uplink signal carrier frequency is equivalent to a downlink signal carrier frequency, no unmodulated portion of the uplink signal is required for transmission of the downlink signal, and no radio frequency gene rating means is included in the apparatus, the transmitted downlink signal being delayed, modulated and amplified.

20. A method comprising:

receiving an uplink signal at an antenna during a receive period;

delaying the uplink signal for a predetermined delay;

modulating the received uplink signal to generate a downlink signal so that the downlink signal's carrier frequency is equivalent to the uplink signal's carrier frequency; and transmitting from the antenna the delayed and modulated downlink signal during a transmit period, wherein the predetermined delay causes the downlink signal to be transmitted during the transmit period without interference from the uplink signal even though a downlink signal carrier frequency is equivalent to an uplink signal carrier frequency and that no unmodulated portion of the uplink signal is required for transmission of the downlink signal.

21. The method of claim 20, further comprising amplifying the received uplink signal.

22. The method of claim 20, wherein the antenna is connected by a switch to supply the received uplink signal for delaying and modulating from the antenna and supply the delayed and modulated downlink signal for transmitting to the antenna.

23. The method of claim 22, wherein switch is such that the system time-multiplexes between the receive period and the transmit period.

24. The method of claim 20, further comprising the steps of converting ambient sound signals with a microphone into electronic signals to control the transmitting step.

25. The method of claim 20, wherein the transmitted downlink signal is a pulse position modulated signal.

26. The method of claim 20, wherein the transmitted downlink signal is a frequency modulated signal.

27. The method of claim 20, wherein the transmitted downlink signal is a phase shift keying modulated signal.

28. The method of claim 20, wherein the delaying step is done using a surface acoustic wave device.

29. A system comprising:

a remote processing unit, the remote processing unit adapted to transmit a modulated uplink signal to an earpiece unit and adapted to receive a modulated downlink signal from the earpiece unit; and the earpiece unit, the earpiece unit including, an antenna for receiving the uplink signal during a receive period and for transmitting the downlink signal during a transmit period, a demodulating circuit operably connected to the antenna, the demodulating circuit adapted to produce an audio signal from the modulated uplink signal, a speaker adapted to receive the audio signal, and a processing circuit including:

a delay element, said delay element causing a predetermined delay of the transmit period from the receive period so that the downlink signal is transmitted during the transmit period without interference from the uplink signal, and a modulator for modulating the received unlink signal to generate the downlink signal, wherein an uplink signal carrier frequency is equivalent to a downlink signal carrier frequency, no unmodulated portion of the uplink signal is required for transmission of the downlink signal, and no radio frequency generating means is included in the earpiece unit.

30. The system of claim 29, wherein, in the earpiece unit, the uplink signal is received by the antenna and the downlink signal is transmitted by the antenna.

31. The system of claim 29, wherein the earpiece unit further comprises a microphone and the downlink signal is modulated with audio data from the microphone.

32. The system of claim 29, wherein the circuitry further includes an amplifier.

33. The system of claim 29, wherein the demodulating circuit is further adapted to produce control information from the modulated uplink signal.

* * * * *